US005257043A

United States Patent [19]

Kneezel

[11] Patent Number: 5,257,043

[45] Date of Patent: Oct. 26, 1993

[54] THERMAL INK JET NOZZLE ARRAYS

[75] Inventor: Gary A. Kneezel, Webster, N.Y.

[73] Assignee: Xerox Corporation, Stamford, Conn.

[21] Appl. No.: 803,929

[22] Filed: Dec. 9, 1991

[51] Int. Cl.[5] ..... B41J 2/05; B41J 2/155

[52] U.S. Cl. ..... 346/140 R

[58] Field of Search ..... 346/140 R

[56] References Cited

U.S. PATENT DOCUMENTS 4,520,373 5/1985 Ayata et al. ..... 346/140 R
4,559,543 12/1985 Toganoh et al. ..... 346/140 R
5,057,854 10/1991 Pond et al. ..... 346/140 R
5,065,170 11/1991 Rezanka et al. ..... 346/140 R

*Primary Examiner*—Benjamin R. Fuller
*Assistant Examiner*—Alrick Bobb
*Attorney, Agent, or Firm*—Robert A. Chittum

[57] ABSTRACT

A thermal ink jet nozzle array comprises a support bar having two major opposing faces parallel to each other and spaced apart by a known thickness and a linear series of modular multi-nozzle printhead units on each support bar face. The series of modular printhead units are spaced apart from each other by equal and known distances, and the series on each support bar face are in a staggered relationship to each other, so that each end nozzle of each intermediate printhead unit is spaced laterally from the respective end nozzle of the nearest printhead unit in the other series by a distance equal to the inter-nozzle spacing of each printhead unit. The row of nozzles of each printhead unit is accurately and releasably positioned on the support bar by mechanical contact of the printhead unit itself against either external jigging or patterned features permanently fabricated on the support bar faces.

8 Claims, 4 Drawing Sheets

THERMAL INK JET NOZZLE ARRAYS

BACKGROUND OF THE INVENTION

This invention relates to thermal ink jet nozzle arrays, and particularly to arrays of modular printhead units arranged in two rows on opposite sides of a structural bar, with the units being staggered so that they combine to form a line of ink drop impact areas extending across the full width of a page on which printing is to be effected.

By "thermal ink jet" in this specification, it is meant that process by which individual drops of ink are ejected from a nozzle by heating the ink in communication with the nozzle, so that some of it vaporizes to form a transitory bubble which pushes a column of ink towards the nozzle. Matters are so arranged that the ink at the end of the column breaks off to form an ink droplet which travels under its own momentum towards a sheet of paper or other copy medium on which drops of ink are intended to fall, with the impact areas partially overlapping so that they form characters or other marks of desired shape. The ink is usually supplied to a plurality of channels, each terminating in a nozzle, from a common reservoir, with each channel being in thermal communication with a selectively energized resistor which produces the bubble in the channel at a precisely chosen time.

Thermal ink jet printheads are presently made and used in units containing 10 to 200 individual nozzles at a linear density of about ten nozzles per millimeter. The largest such printhead that it is presently practical to make with reasonable yield is of the order of 10 to 20 mm long. Such printheads are scanned across the medium to be marked (usually of sheets of paper) in order to print the entire page. Maximum drop ejection repetition frequency, as well as over-scan time and turnaround time, limits the print speed to about four pages per minute at a resolution of 12 dots per mm. Fabrication of a page-width print bar enables the print speed to increase to 10 to 100 pages per minute, by increasing the number of nozzles which may be made to eject ink drops at the same time, as well as by eliminating time wasted at the ends of scan lines. Assembly of a page-width print bar requires the precise location of several printhead modules. Of course it is not essential that a multi-module print bar be of page-width. In some applications, such as wide plotters, it may be desirable to increase plotting speed higher than is possible from the single printhead unit, but not necessary to use a print bar that extends across the full width of the plotter. In such a case, a multi-module printhead could be scanned across the paper. It may also prove advantageous, when wishing to print bi-color or multi-color images, to mount several printhead modules precisely on a bar, with each module being dedicated to ink of a specified color.

A page-width thermal ink jet bar will be composed of several printhead modules. These modules must be accurately positioned with respect to each other so that the line of picture elements (pixels) produced by printed droplets from neighboring modules show no seams, and the pixels appear to be produced by one continuous line of uniformly-spaced ink drop nozzles. It is further advantageous if the modules are replaceable, so that if one were defective it would not cause the entire print bar to be rejected. One way to achieve the two objectives of precise registerability and replaceability would be to build complex adjustment capability into the print bar substrate, as is disclosed in U.S. Pat. No. 4,559,543 to Toganoh et al. in which these adjustment features are labelled 107 and 108 in FIG. 1 of the patent. The disadvantage of this approach is the complexity, and therefore the cost of the print bar. The reason that the adjustment capability is needed in '543 is that there is no provision on each module for a precise location surface relative to the nozzles. For example, it is the base plate 202 (FIG. 2) which is shown as being in contact with the page-width substrate. Neither the base plate nor the adhesive joint to the thermal ink jet die or subunit have sufficiently precise thickness to ensure that the ink jets from adjacent modules would line up adequately to form a precise line of pixels, with no overlapping and no gaps.

SUMMARY OF THE INVENTION

It is an object of the present invention to provide a print bar carrying an array of modules of thermal ink jet nozzles, in which the modules are precisely registered with respect to each other by using reference surfaces on the modules which are precisely related to the nozzles themselves.

It is another object of the present invention to provide a print bar carrying an array of readily replaceable modules of thermal ink jet printhead units with each containing a plurality of nozzles, while retaining the ability of being precisely registered with respect to each other by using reference surfaces on the modules which are precisely related to the nozzles themselves.

In the present invention a thermal ink jet nozzle array comprising a support bar having two major opposing faces parallel to each other and spaced apart by a known thickness is provided. Each face supports a linear series of modular multi-nozzle printhead units spaced apart from each other by equal and known distances. The two series of printhead units on opposing faces of the support bar are in a staggered relationship to each other, whereby each end nozzle of each intermediate modular unit is spaced laterally from an orthogonal projection of the respective end nozzle of the nearest modular unit in the other series by a distance equal to the inter-nozzle spacing of each module. Thus, the row of nozzles of each modular unit is accurately positioned on the bar by mechanical contact with the printhead unit itself.

Accordingly, the present invention provides a thermal ink jet nozzle array which is as claimed in the appended claims.

The present invention will now be described by way of example with reference to the accompanying drawings, in which like references denote like components.

DESCRIPTION OF THE PREFERRED EMBODIMENT

Figure 1:
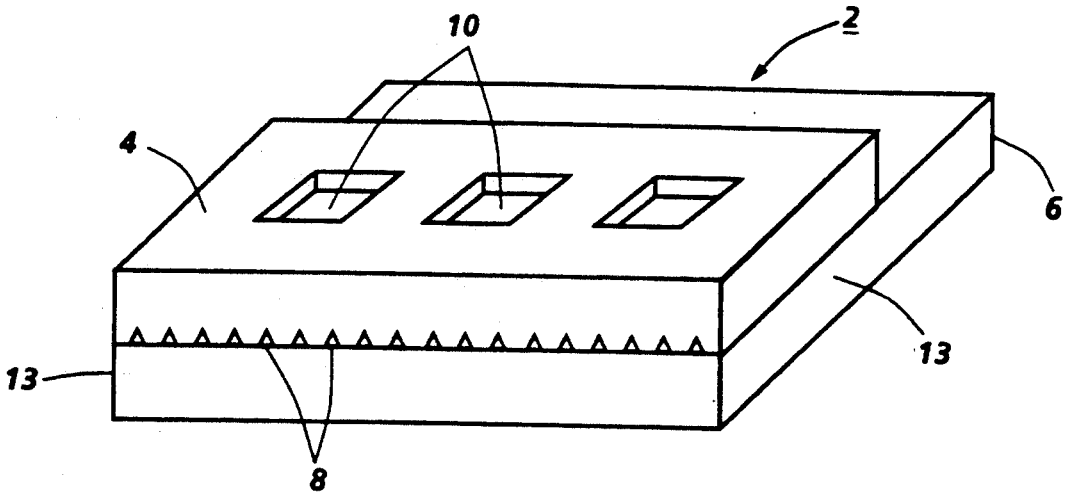
FIG. 1 is a diagrammatic isometric view of a basic printhead die or subunit able to be used in the array of the present invention.

The printhead die or unit 2 shown in FIG. 1 has its two basic components a channel plate 4 bonded to a heater plate 6. As is well-known, that face of channel plate 4 which is to be bonded to the heater plate 6 is provided with a series of substantially parallel V-shaped ink channels, so that when the two plates are bonded together the heater plate covers all the aligned channels to produce a linear series of uniformly spaced triangular nozzles 8 through which drops of ink are ejected on demand. The mating face of heater plate 6 is provided with a series of resistors (not shown) and integral conductors (not shown) so that each resistor may be selectively energized at a precisely chosen time, with the heat produced by the resistor being used to vaporize momentarily a small proportion of the ink in the associated channel and form a temporary bubble that ejects from the respective nozzle 8 a drop of ink (not shown) travelling in a direction specified by the alignment of the ink channel. A printhead unit is positioned near a sheet of paper or other copy medium aligned with the ink channels, and printing is effected by exercising precise control over the application of pulses of electrical current to the selected resistors.

The outer surface of the channel plate 4 is provided with one or more (three shown in FIG. 1) apertures 10 through which ink may be supplied to a common reservoir (not shown) and each of the channels (not shown) which provide communication between the nozzle 8 and the common reservoir are supplied with ink from the common reservoir. The internal geometry of the channels, the disposition and manner of construction of the resistors, and the arrangements for keeping the channels replenished with ink are already known, and so will not be described in greater detail in this specification.

Figure 2:
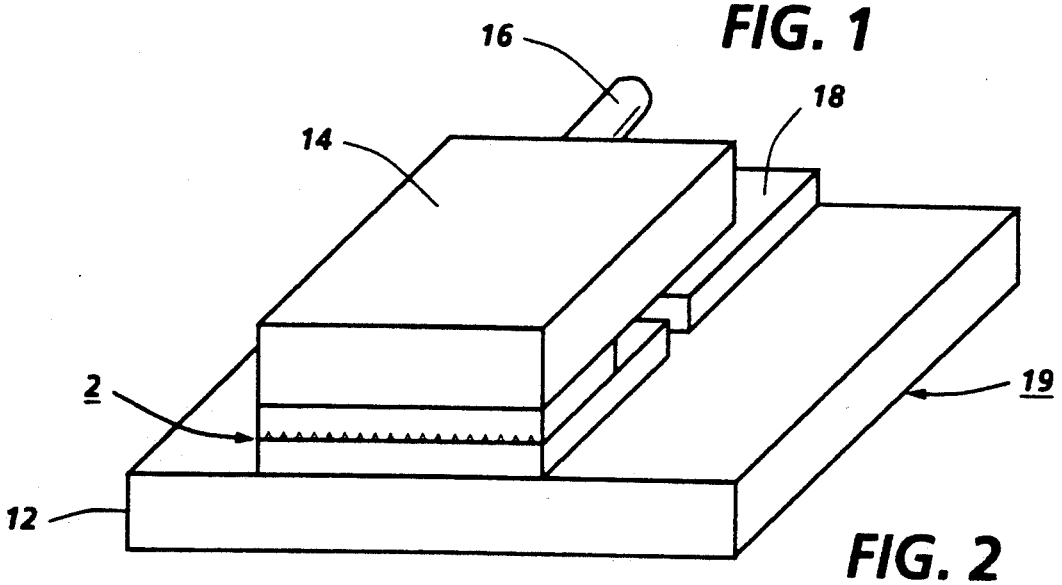
FIG. 2 is a diagrammatic isometric view of a printhead module incorporating the printhead die and able to be used in an array of the present invention.

In that form of printhead modules 19 shown in FIG. 2, the printhead die or unit 2 is sandwiched between a heat sinking substrate 12 and an ink manifold 14 to which ink is supplied by a conduit 16 from the rear. Also shown is an interconnect board 18 bonded to the same face of substrate 12 as is the outer surface of heater plate 6. The interconnect board 18 is used to control the supply of heating current to the resistors on heater plate 6 by, for example, wire bonds (not shown) connecting the resistor conductors to the interconnect board. The interconnect board is connected to a voltage supply and/or other control circuitry (not shown) by ribbon cable (not shown).

Figure 3:
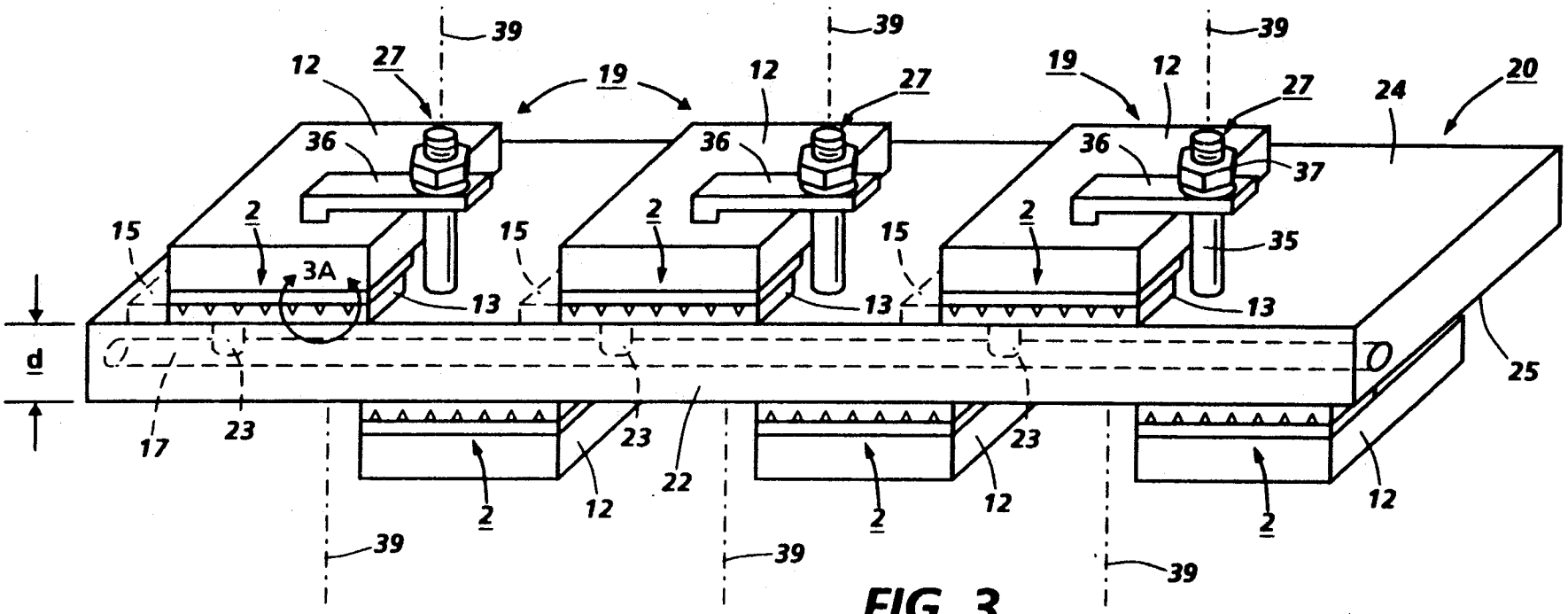
FIG. 3 is a diagrammatic isometric view of a print bar cooperating with several printhead modules as shown in FIG. 2 to form an array of the present invention.

In FIG. 3 is shown a print bar 20 having a series of printhead modules 19 secured to each of its major faces 24, 25 with the modules on each face being exactly aligned with each other and being laterally spaced apart by precise distances. The nozzles of each printhead module are coplanar with each other and the side face 22 of the print bar. Lateral alignment of the modules is controlled precisely either by external assembly fixture or jigging (not shown), which are not a permanent part of the printhead module, or by patterned features 15 (shown in dashed line) permanently fabricated, for example, through photolithography on the print bar to position the sides 13 of the precisely diced printhead die 2. The two rows of modules are themselves staggered so that the incremental series of ink nozzles provided by each module are aligned precisely with the modules on the other side of the print bar so that when the nozzles are energized and their ink drops fall on a copy medium moving perpendicularly to the side face 22 of the print bar 20 (shown in FIG. 5) their impact areas form a continuous line of uniformly-spaced dots which may partially overlap each other.

Figure 3A:
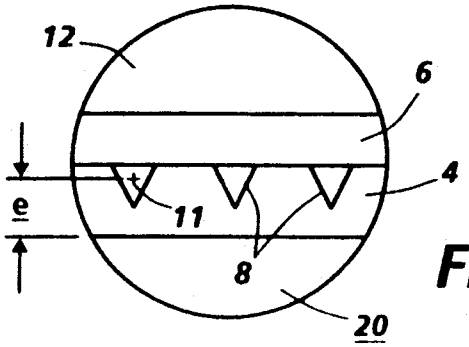
FIG. 3A is an enlarged partially shown front view of the print bar and printhead module showing the distance of the nozzle centers from the print bar, the portion of the printhead module and print bar being that region circled as 3A in FIG. 3.

An important point to note about FIG. 3 is that the printhead dies are inverted relative to their orientation shown in FIGS. 1 and 2. With the orientation shown, it is the channel plates 4 which have their surfaces in contact with the respective major surface of bar 20, and it is the heat sinking substrates 12 which come to be positioned remotely of the print bar. This necessitates elimination of the ink supplying manifolds 14. Instead of manifolds 14, ink is provided to the respective apertures 10 of the channel plate by means of passages 17 formed in the interior of bar 20 and shown in dashed line, which passages therefore function as an ink manifold common to both sets of printhead modules. In practice, the major faces of print bar 20 would be precisely flat and parallel to each other and spaced apart by a known distance d in this form of array of the present invention. The line of nozzles of each module are spaced from the respective support surface of bar 20 by a distance which is controlled only by the dimensions of the channel plate, and, as the channel plate manufacture is a precise process, the distance between the effective center 11 of each triangular nozzle 8 and the outer surface of the channel plate with the ink inlet apertures 10 (distance e in FIG. 3A) is also precisely known. Thus, in the FIG. 3 embodiment, the nozzles of the modules are spaced apart from each other perpendicularly to the surfaces 24 and 25 by a distance $d+2e$, since the channel plate surface with the apertures is in contact with the major surfaces of the print bar.

Typically, the position of the printhead face containing the nozzles relative to the paper or other recording medium moving past the fixed print bar and printhead modules mounted thereon is monitored precisely by encoder pulses. Pulsing of selected resistors with current pulses to eject droplets from printhead modules on the trailing side of the print bar 20 would be delayed by a number of encoder pulses corresponding to the distance $d+2e$, so that the respective spots or pixels printed by the ink droplets would not be displaced from the pixels printed by droplets ejected from the printhead modules on the leading side of the print bar 20. Thus, in order to ensure that an ink drop from a module on one side of the print bar 20 falls precisely aligned across the width of the copy medium with an ink drop ejected from a module on the other face of the print bar, each heating pulse to the latter modules is delayed by the above interval, after the time of application of the heat impulses to the former modules, when it is intended that successive ink drops fall on the same line extending perpendicularly to the path of movement of the paper.

Another important feature of the embodiment of FIG. 3 is that the printhead modules 19 may be releasably fastened into their precise locations by any known fastening means, such as, for example, clamps 27. Clamp 27 comprises a stud 35 with axis 39 fixedly mounted on the print bar major surfaces 24, 25 at locations adjacent the areas reserved for the installation of the modules. The distal ends of the studs are threaded, so that an arm 36, swivelly mounted at one end on the stud, may be tightly held in place against the heat sinking substrate of the modules by a lock nut 37. When using this releasably held configuration for the print bars, resilient gaskets (not shown) must be bonded to the print bar major surfaces 24, 25 surrounding the openings 23 which place the passages 17 in the print bar 25 in communication with the ink inlet apertures 10 of the printhead die 2. In this manner the modules will be tightly sealed to the print bar, so that ink will not be leaked at the interface between the print bar and the modules, and at the same time may be readily removed and replaced without disturbing the other modules, thereby providing the flexibility of removing only damaged or inoperative modules without requiring the disposal of the entire fully assembled print bar. The replaceability of the modules dramatically increase the yield during print bar fabrication and thus, reduces the manufacturing cost of pagewidth ink jet print bars.

Figure 4:
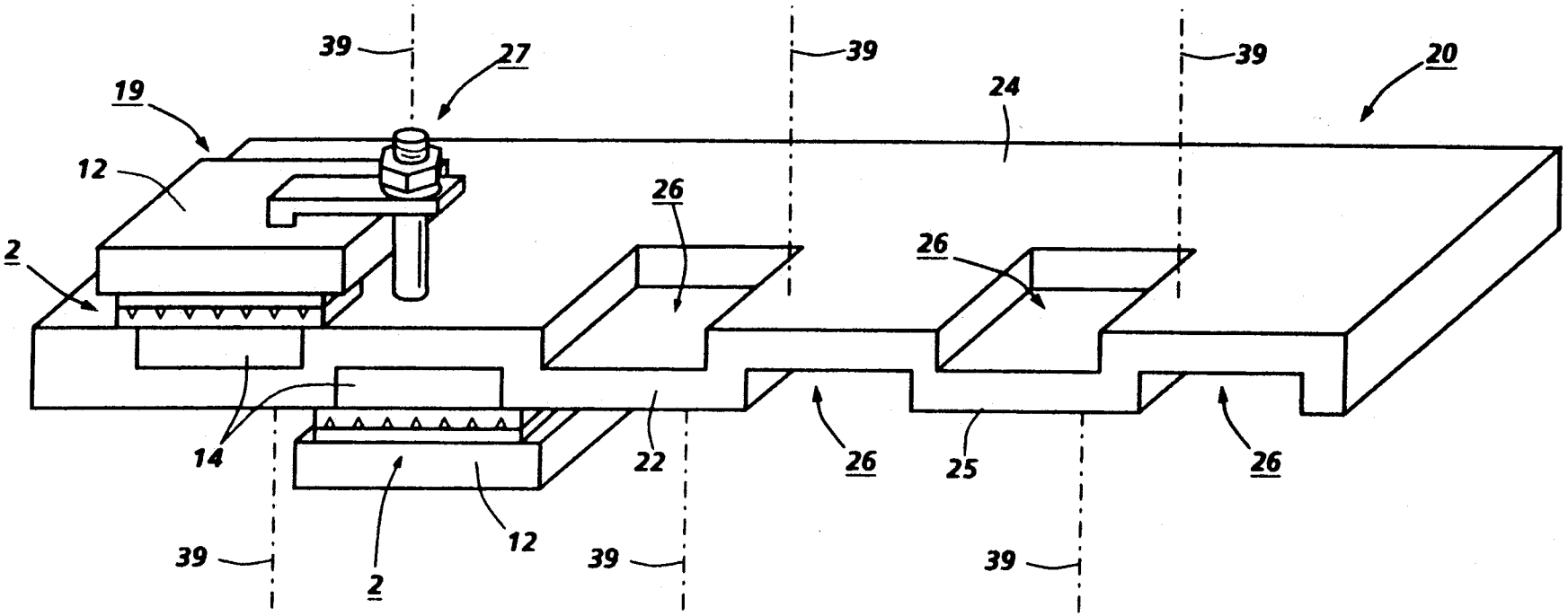
FIG. 4 is a view similar to FIG. 3 of a modified form of print bar.

FIG. 4 shows an embodiment similar to that of FIG. 3, but in which modules of the type shown in FIG. 2 are used. To this end, the bar 20 has its major surfaces 24 and 25 provided with a staggered series of rectangular shaped recesses 26, each being open to the side face 22. The recesses are dimensioned so that they accommodate the ink manifolds 14. The ink manifolds may themselves be connected by umbilical conduits (not shown) to an ink supply, so that ink passages need not be provided internal of bar 20. It will be noted that the ink manifolds are narrower than the width of the faces of the channel plates to which they are bonded, so that the nozzles are spaced from the reference surfaces 24 and 25 by exactly the same distances as in the FIG. 3 embodiment. The modules 19 may also be releasably mounted in the recesses 26 of the print bar by releasable fastenings means such as the clamps 27 of the embodiment of FIG. 3.

Figure 5:
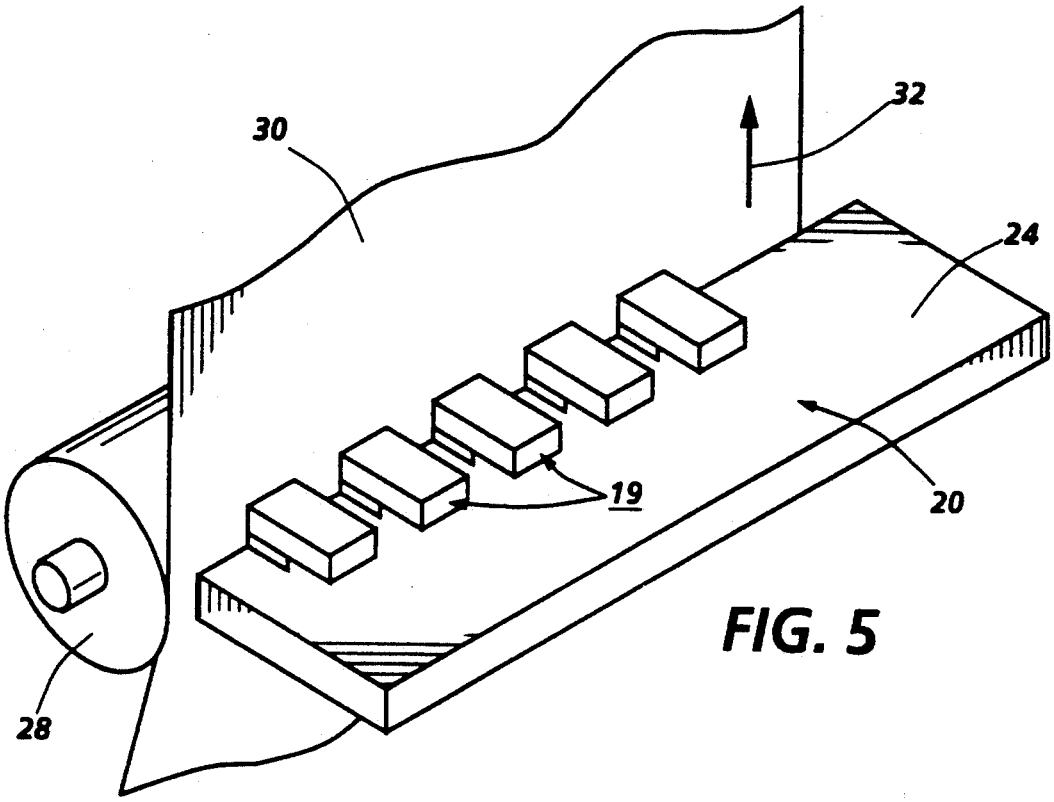
FIG. 5 is a diagrammatic view of a print bar as shown in FIG. 3 or FIG. 4 in position to print on an opposing sheet of paper or copy medium.

FIG. 5 shows the essential components of an ink jet printer, with all unessential components having been omitted for clarity. The print bar 20 of FIGS. 3 or 4 is mounted so that it is directly aligned with the rotational axis of a platen roller 28. Contacting the platen 28 is a sheet 30 of paper or other copy medium. The direction in which the sheet 30 moves with respect to the print bar 20 is indicated by arrow 32. Thus the sheet 30 has ink drops from the lower (unseen in FIG. 5) modules falling on it before any ink drops from the upper modules 19 is already discussed. If the ink drops from the upper modules are delayed for an appropriate period after the drops from the lower modules, then they can fall on exactly the same line across the sheet as the drops from the lower set, with the spacings laterally of references surface 24 being controlled precisely, and with the time of ejection of ink drops from the two rows of modules 19 being similarly controlled, the result is that an absolutely uniformed line of pixels can be produced.

Although FIG. 5 shows the print bar 20 as extending across the full width of the sheet 30, it is within the purview of the present invention to provide a print bar of less width which can be mounted on a carriage so that the print bar is scanned across the width of the sheet 30. Also, multiple carriage mounted modules can provide higher printing speed or multiple colors not available from a single carriage mounted module. By dedicated different modules 19 to inks of different colors, such scanning can be used to produce images containing two or more different colors. The manner in which such a shorter print bar would be mounted and driven across the width of the sheet 30 are known in themselves and do not form part of the subject matter of this invention, and therefore will not be described herein in any greater detail.

Figure 6:
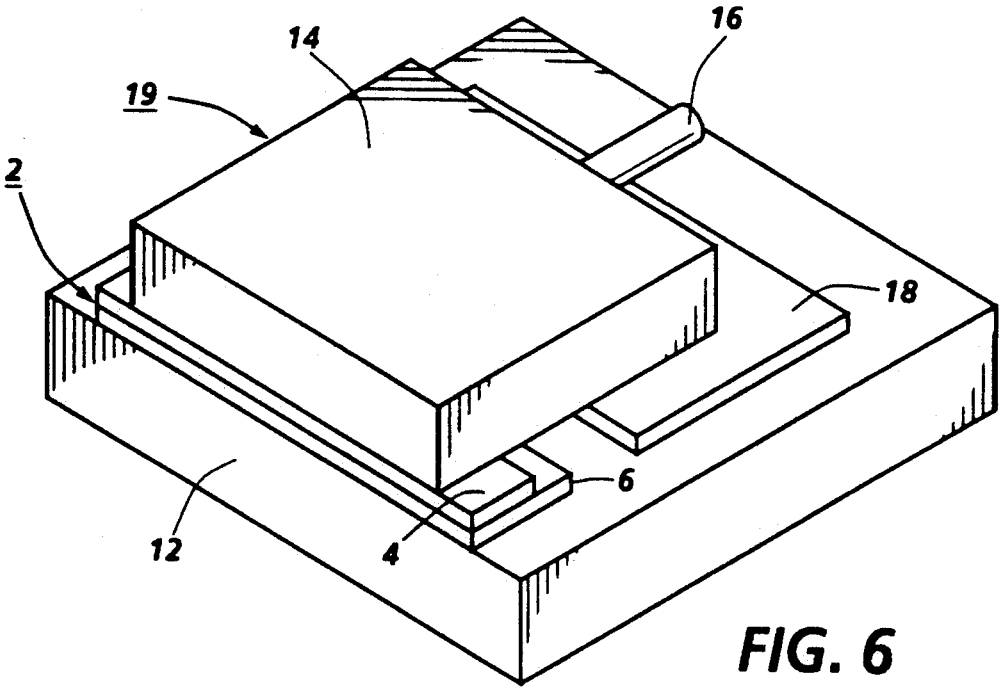
FIG. 6 is a diagrammatic perspective view of an alternative form of the printhead module shown in FIG. 2.

The printhead module 19 shown in FIG. 6 is an enlarged view of the module 19 shown in the FIG. 4 embodiment, in which the ink manifold 14 is narrower than the respective dimension of the printhead die, which may be in turn narrower than the respective dimension of the heat sinking substrate 12.

Figure 7:
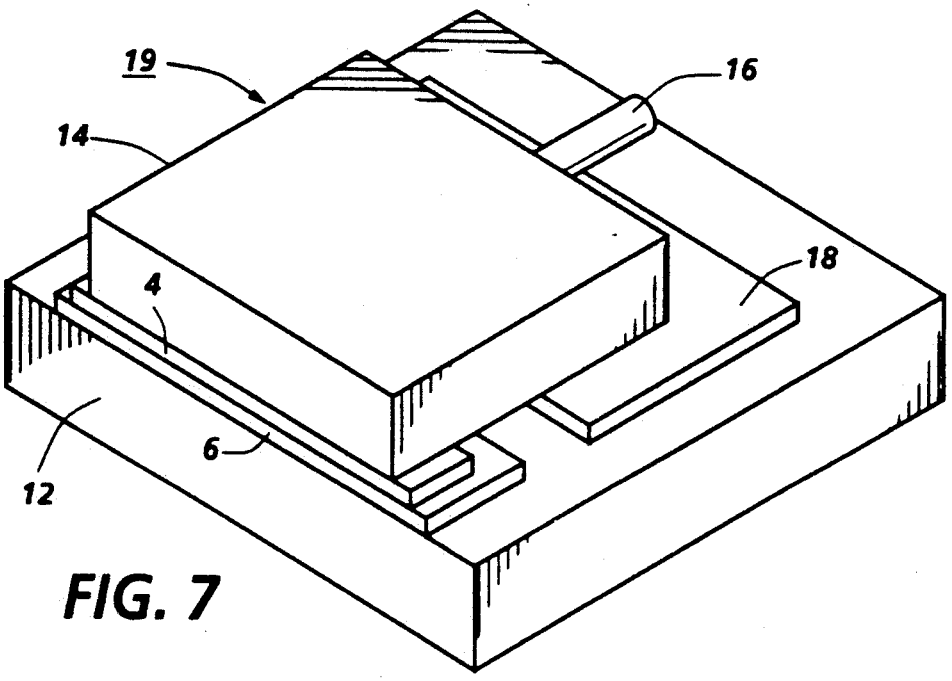
FIG. 7 is a diagrammatic perspective view of a further alternative to the printhead module of FIG. 2.

The module 19 shown in FIG. 7 is largely identical with that shown in FIG. 6 except for the different widths of the channel and heater plates. As shown, the heater plate 6 extends beyond the side faces of the channel plate 4 so that the module 19 can be registered on the print bar on top of the heater plate, thus providing even closer control of the relative positions of the ejection nozzles despite manufacturing variations in thickness of the channel plate.

Thus, it will be seen that the present invention provides an array of precisely positioned printhead modules of which the spacings apart are known precisely so that they can be controlled to give a line of uniformly-spaced pixels across any desired width of the medium on which printing is to take place.

I claim:

1. A thermal ink jet nozzle array comprising a support bar having two major faces parallel to each other and spaced apart by a known thickness, each face supporting a linear series of printhead modules which include multi-nozzle printhead die, each printhead die having a linear series of uniformly spaced nozzles through which drops of ink are ejected on demand, the modules being spaced apart from each other by equal and known distances, the two series of modules being in a staggered relationship to each other, whereby each end nozzle of each intermediate module in one of the series is spaced laterally from an orthogonal projection of a respective end nozzle of the nearest module in the other series by a distance equal to the nozzle spacing of each module, wherein each module is accurately positioned on the support bar by use of the printhead die against an alignment element, so that the linear series of nozzles provided by the printhead die of each module on one face of the support bar are aligned precisely with the linear series of nozzles of the modules on the other face of the support bar, and means for releasably holding each printhead module in place on said support bar.

2. An array as claimed in claim 1, wherein each printhead die comprises a channel plate having an outer face and an inner face with ink flow directing recesses therein, the channel plate inner face being bonded to a heater plate having an inner face and an outer face, the heater plate inner face having an array of selectively addressable resistors; wherein each printhead die have a linear series of ink jet nozzles in a front face thereof, a reservoir with an aperture serving as an ink inlet, and channels placing the reservoir into communication with the nozzles, said reservoir and channels being formed by the channel plate recesses when the channel plate and heater plate are bonded together; wherein each heater plate is bonded to a separate heat sinking substrate having a face coplanar with the said printhead die front face; and wherein the outer face of the channel plate has said aperture and lies in a plane of the respective major face of the support bar.

3. An array as claimed in claim 2, wherein the aperture of the printhead die is in fluid-tight communication with an ink supply.

4. An array as claimed in claim 3, in which the ink supply takes the form of an internal passage in the support bar.

5. An array as claimed in claim 3, in which the ink supply takes the form of a manifold, one manifold for each printhead die.

6. An array as claimed in claim 5, wherein each module is partially seated in a recess formed in the respective major face, each recess also opening into a side face of the support bar which lies between both series of nozzles.

7. An array as claimed in claim 6, wherein the means for releasably holding each printhead module in position is by a releasable clamping means, so that any module may be readily replaced.

8. An array as claimed in claim 6, wherein opposing ends of the heater plate extend beyond the side faces of the channel plate, so that the extended opposing ends of the heater plate inner face rest on opposing edges of the recesses in the support bar and thereby enable the placement of the heater plate inner face on the respective support bar major surfaces, with the channel plate and manifold residing in the support bar recesses, thereby shortening the distance between the nozzles on opposite sides of the support bar and tightening the position tolerance by removing any channel wafer thickness variations.

* * * * *